US006904953B2

(12) United States Patent
Frick et al.

(10) Patent No.: US 6,904,953 B2
(45) Date of Patent: Jun. 14, 2005

(54) COOLING ARRANGEMENT FOR THE ROLLING STAND OF A CONTINUOUS CASTING SYSTEM

(75) Inventors: Juergen Frick, Weinstadt (DE); Roman Haap, Waldenbuch (DE); Albert Fecht, Riederich (DE)

(73) Assignee: Lechler GmbH, Metzingen (DE)

( * ) Notice: Subject to any disclaimer, the term of this patent is extended or adjusted under 35 U.S.C. 154(b) by 41 days.

(21) Appl. No.: 10/188,042

(22) Filed: Jul. 3, 2002

(65) Prior Publication Data

US 2003/0159794 A1 Aug. 28, 2003

(30) Foreign Application Priority Data

Feb. 28, 2002 (EP) ..... 02004596

(51) Int. Cl.[7] ..... B22D 11/124
(52) U.S. Cl. ..... 164/444; 164/448; 164/348
(58) Field of Search ..... 164/444, 448, 164/342, 442, 348

(56) References Cited

U.S. PATENT DOCUMENTS 3,885,741 A * 5/1975 Wagener et al. ..... 239/268
3,943,641 A * 3/1976 Dworetzky ..... 434/350
4,237,959 A * 12/1980 Yamamoto et al. ..... 164/451
4,250,951 A * 2/1981 Mezger et al. ..... 164/444
4,501,314 A * 2/1985 Wakabayashi et al. ..... 164/441

FOREIGN PATENT DOCUMENTS

DE 20010074 10/2000

OTHER PUBLICATIONS

Michael Cygler, et al. "Near net shape casting and associated mill developments" Iron and Steel Engineer, vol. 72, No. 1, Jan. 1995.
Search Report.

* cited by examiner

*Primary Examiner*—Kiley Stoner
*Assistant Examiner*—Len Tran
(74) *Attorney, Agent, or Firm*—Crowell & Moring LLP

(57) ABSTRACT

A cooling arrangement for the rolling stand of a continuous casting system for heavy supports is provided with spraying nozzles which can be acted upon by cooling liquid and compressed air through supply pipes laid laterally in a longitudinal direction of the rolling stand. Only two supply pipes for cooling liquid and compressed air respectively are assigned to each side of the rolling stand. The supply pipes are laid parallel to one another and are equipped with connection flanges on which connection plates can be mounted in a simple manner and, in turn, are fixedly connected with spraying nozzles. This further development permits a simple mounting and demounting of the spraying nozzles and ensures a precise alignment of the spraying jets with respect to the billet to be processed.

19 Claims, 3 Drawing Sheets

COOLING ARRANGEMENT FOR THE ROLLING STAND OF A CONTINUOUS CASTING SYSTEM

BACKGROUND AND SUMMARY OF INVENTION

This application claims the priority of European Patent Application 02004596.9 filed Feb. 28, 2002, the disclosure of which is expressly incorporated by reference herein.

The invention relates to a cooling arrangement for the rolling stand of a continuous casting system for heavy supports with spraying nozzles which can be acted upon by a cooling liquid and by compressed air through lateral supply pipes laid in the longitudinal direction of the rolling stand.

Cooling arrangements of this general type are known. FIG. 3 shows such an arrangement. Such pipe and nozzle arrangements for supplying the secondary cooling system of the continuous casting system, for a further development with two nozzles for each side, have at least three pipes. In this case, one pipe, for example, pipe L, supplies compressed air which is guided through a T-piece to both spraying nozzles D, and the two other pipes W supply the cooling liquid in the form of water to one of the spraying nozzles respectively. These three lines L and W extend parallel to the casting billet S which is to be shaped here into the shape of a double-T support within the rolling stand, in which various rollers R1, R2 and R3 shape the billet S. The spraying nozzles D are in each case arranged such that they spray into the gaps between adjacent rollers R1 and in this case, if possible, contact the entire lateral surface of the billet S with their spraying jet.

Since the feed pipes W and L extend parallel to the billet S, they have to be laid outside the respective segment frame. The supply with compressed air and water takes place by way of relatively thin lines $L_1$ which have to be bent corresponding to the spraying direction. As illustrated in FIG. 3, for this purpose, at least three of the stub lines $L_1$, of which two are bent, are required, as well as a distributor piece which is situated in-between and is provided here for the compressed air supply, but may also be provided for the water supply if compressed air is guided through the exterior pipes W.

The installation of such a pipe arrangement requires relatively high expenditures. A precise alignment of the spraying nozzles D with respect to the target surface of the billet S is difficult and, depending on the quality of the maintenance, there is also a considerable risk that areas of the billet S are acted upon which are to remain uncooled. In addition, the removal of an individual nozzle for maintenance purposes is not possible without the removal of the complete supply pipes W, L.

It is therefore an object of the present invention to further develop a cooling arrangement of the initially mentioned type such that its construction is simpler and operationally more reliable and that the mounting and installation expenditures can be kept as low as possible.

For achieving this object, it is provided in the case of a cooling arrangement of the initially mentioned type that only one cooling liquid and compressed-air pipe respectively is assigned to each rolling stand side, which are laid parallel to one another and are provided with connection points for the joining of connection plates which are fixedly connected with the spraying nozzles.

This further development requires only two pipes for supplying the secondary cooling system with air and water.

Bent stub lines or distributor pieces, which are difficult to manufacture and require high expenditures, will therefore not be necessary. The flanging of a connection plate to the two supply pipes, which have corresponding connection points, is sufficient. These connection plates, in turn, will then already carry the correspondingly aligned or arranged spraying nozzles. As a result, the mounting or demounting becomes significantly simpler.

As a further development of certain preferred embodiments of the invention, the connection points at the supply pipes can be constructed as a flange to which the connection plates can be joined in a simple manner. It is also advantageous according to certain preferred embodiments of the invention to place the two supply pipes at a narrow distance from one another so that they can be provided in a simple manner with a joint connection flange for fastening the connection plates.

In principle, this results in the possibility to provide the connection flanges only on one side on the supply pipes and to provide a connecting link on the other side of the supply pipes, so that studs for mounting the connection plates can be guided through the space between the supply pipes and can be anchored in the connecting link.

However, it is also contemplated to provide the connection flanges on both sides on the supply pipes and to provide them with one connection thread for studs respectively for the flanging-on of the connection plates for certain preferred embodiments of the invention.

As a further development of certain preferred embodiments of the invention, the connection plate can be fixedly connected with two spacer pipes, of which one is connected with the compressed air and the other is connected with the cooling-liquid pipe, the spacer pipes ending in a flange which can be fixedly connected with the nozzle housing which is provided with two spraying nozzles situated at a certain angle with respect to the one another and to the axes of the spacer pipes. In this case, these spraying nozzles are connected in this housing with a mixing chamber and with ducts for guiding the compressed air and the cooling liquid. The connection plate also has passage openings to the spacer pipes which adjoin the connection flanges of the supply pipes in a sealed-off manner.

In the case of a variant of the invention, it may, however, also be provided that the connection plate itself is provided with a mixing chamber in the interior which, by way of connection ducts, is connected with the compressed-air and the cooling-liquid connection and has an outlet connection piece which is connected with a connection pipe piece to a spraying nozzle. In the case of this embodiment, the mixing of cooling liquid and compressed air can therefore take place within the connection plate and the spraying mixture will then be supplied to the assigned spraying nozzle or to several assigned spraying nozzles.

In this last mentioned embodiment, the connection pipe piece to the spraying nozzles can have a bent construction with respect to the laying plane of the supply pipes. It can also be detachably joined to the outlet connection piece and be provided with a protection against torsion which ensures that the connection pipe pieces to the spraying nozzles can be attached to the outlet connection piece only in a defined position. This further development therefore ensures the alignment of the spraying jet, so that an operator will not have to adjust this spraying angle by bending pipes in a high-expenditure manner. As a result, it is also possible to implement both spraying positions by means of an identical connection piece with a spraying nozzle.

The invention is illustrated in the drawing by means of two embodiments and will be explained in the following.

Other objects, advantages and novel features of the present invention will become apparent from the following detailed description of the invention when considered in conjunction with the accompanying drawings.

DETAILED DESCRIPTION OF THE DRAWINGS

Figure 1:
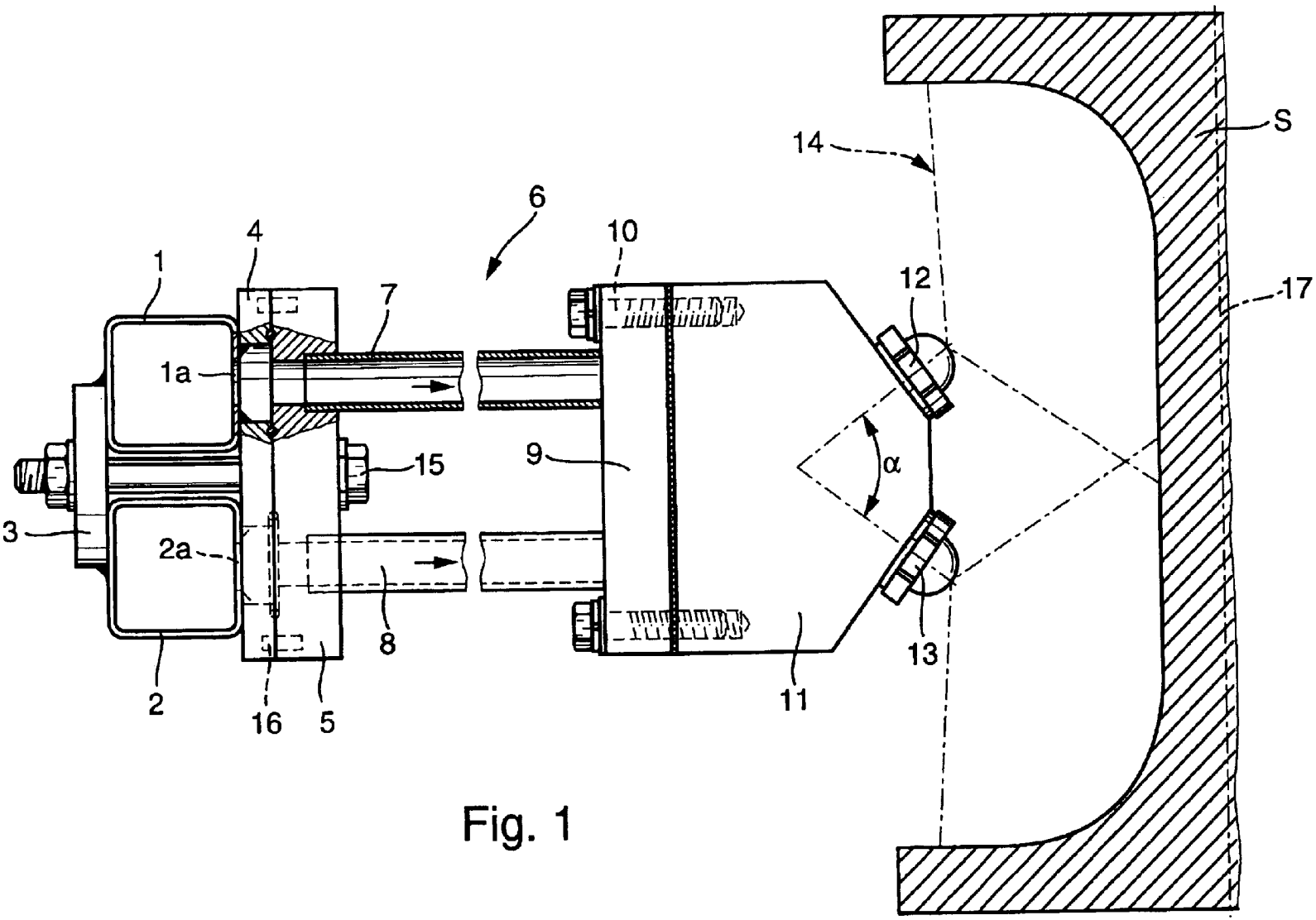
FIG. 1 is a schematic view of a spraying nozzle arrangement of a cooling arrangement according to a preferred embodiment of the invention, having two spraying nozzles arranged in a housing block and a spacer pipe arrangement, viewed in a longitudinal direction of a billet being formed.
Figure 3:
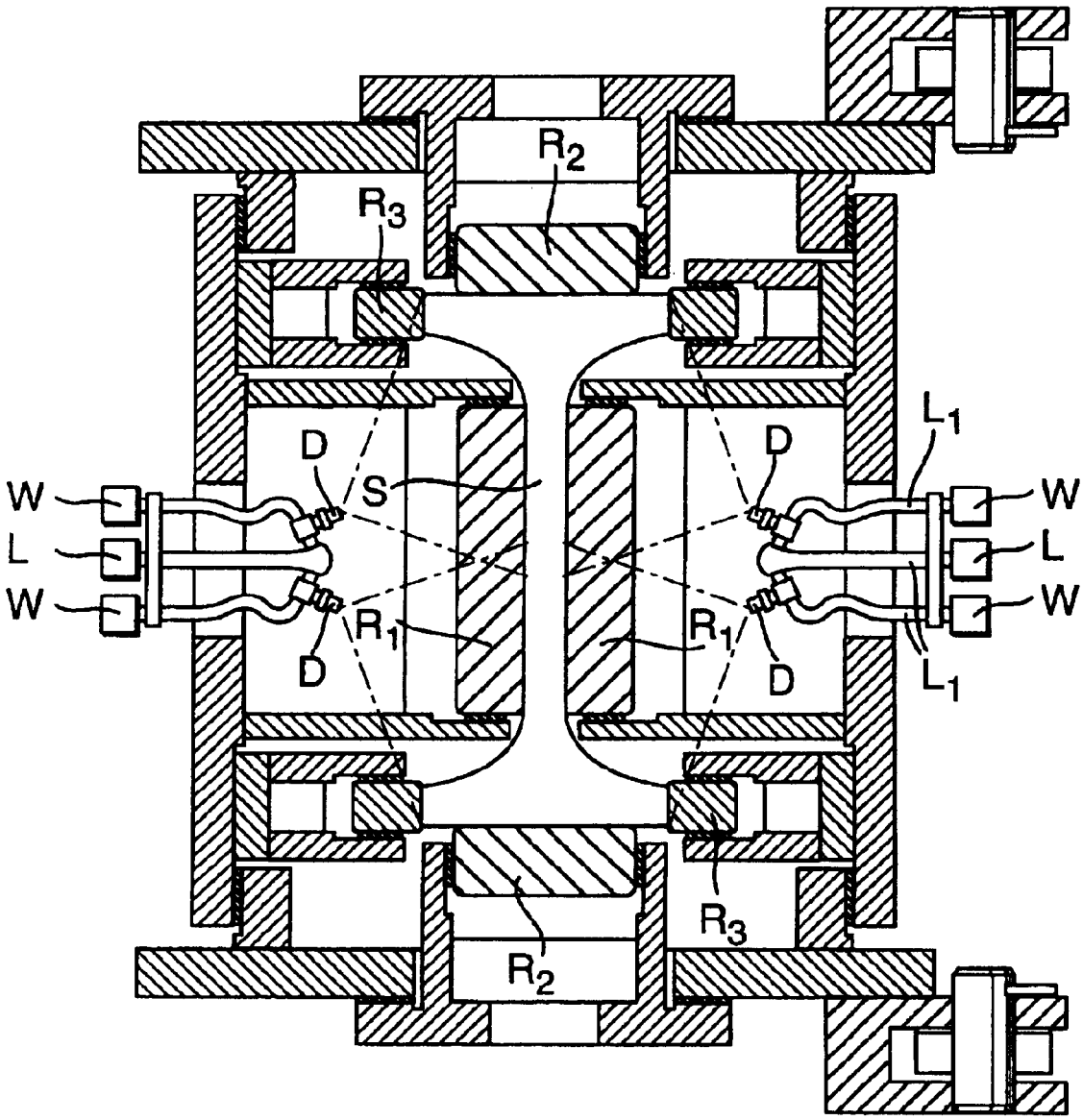
Fig. 3 PRIOR ART
FIG. 3 is a schematic cross-sectional view of a rolling stand of a continuous casting system with a cooling arrangement according to the prior art.

FIG. 1 illustrates that two supply pipes 1 and 2 each having a square or rectangular cross-section are laid at a narrow mutual distance in the longitudinal direction of the billet S and parallel to its center plane 17, which billet is guided and shaped, as explained by means of FIG. 3, in a rolling stand of a continuous casting system. The two supply pipes 1 and 2, of which one is used for supplying compressed air and the other is used for supplying cooling liquid or water, are connected with one another by links 3 arranged at certain distances on the one side and by connection flanges 4 each situated opposite the links 3, and are provided in each case with openings 1*a* and 2*a* respectively on the side of the connection flanges 4, by way of which openings 1*a* and 2*a* respectively compressed air or water can enter into corresponding passage openings respectively of the flanges.

One connection plate in the form of a flange 5 of a spacer pipe unit 6 respectively is joined to each connection flange 4, which spacer pipe unit 6 includes two spacer pipes 7 and 8 and another flange 9 to which, again by means of screws 10, a nozzle housing 11 is flanged. In a manner not illustrated in detail, this nozzle housing 11 is provided with a mixing chamber in the interior, into which compressed air and cooling liquid penetrates from the spacer pipes 7 and 8 and is mixed. The coolant/compressed-air mixture is then fed to the two spraying nozzles 12 and 13 which are aligned at an angle $\alpha$ with respect to one another which had previously been adapted to the shape of the billet S together with the spraying pattern of the spraying jet 14.

The cooling system and the rolling stand respectively are also adapted to the length of the spacer pipes 7 and 8.

It is easily recognizable that, in the case of such an embodiment, the spacer pipe unit 6 can be joined in a simple manner to the flange 4 and can be fastened by means of a stud 15 which extends through the flanges 4 and 5, through the gap between the supply pipes 1 and 2 and through the link 3. In this case, it is possible to ensure a precise alignment of the spacer pipe unit 6 and therefore also of the spraying nozzles 12 and 13 by means of alignment pins 16 which permit an exact mutual alignment of the flanges 4 and 5.

It is also plausible that, in this embodiment, only two supply pipes are required and that the maintenance of the nozzles 12, 13 is significantly easier because, for this purpose, after the release of the stud 15, the entire spacer unit 6 together with the nozzle housing 1 can be removed in a simple manner without the requirement of demounting the supply pipes 1, 2. After the reattaching of the spacer pipe unit, the spraying nozzles 12, 13 will be precisely aligned again without the requirement of cumbersome adjusting operations. The spraying nozzles 12, 13 or their mouthpieces are restrictedly aligned at the nozzle housing 11, which also applies to the arrangement of the nozzle housing 11 with respect to the spacer pipe unit 6 and to the alignment of the spacer pipe unit 6 with respect to the supply pipes 1 and 2.

Figure 2:
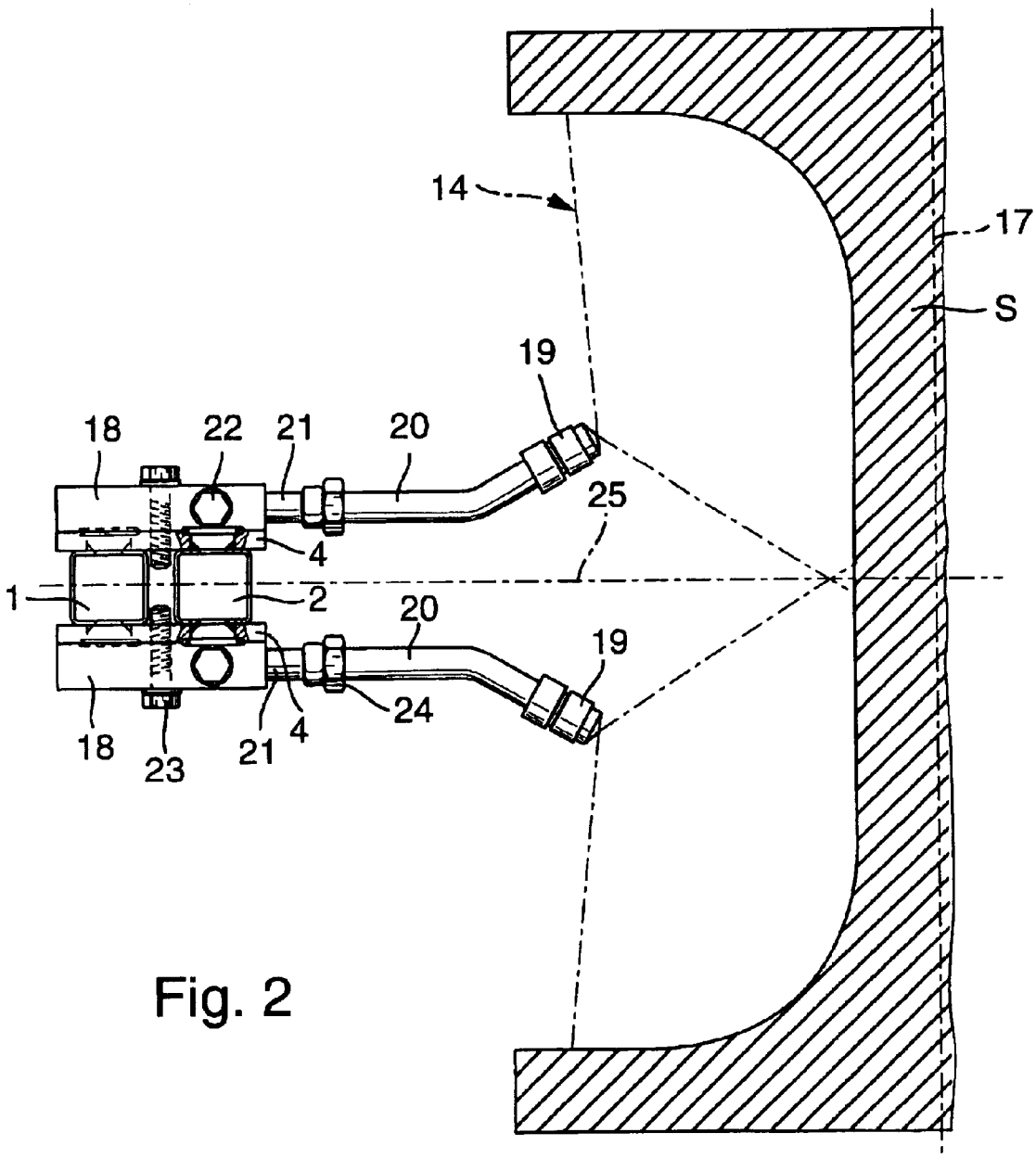
FIG. 2 is a view similar to FIG. 1 showing another preferred embodiment of the invention, with a cooling arrangement with two spraying nozzles to be flanged on separately.

FIG. 2 shows a variant of a cooling arrangement according to the invention. Here, the two supply pipes 1 and 2 are again aligned parallel to one another, side-by-side and parallel to the center plane 17 of the billet S. However, here they are also not arranged below one another but side-by-side in a horizontal laying plane 25 and are equipped on their top side as well as on their underside with flanges 4 which, again by way of their passage openings, establish the connection to the compressed air and the cooling liquid supply. The connection plates 18 are in each case joined to the two flanges 4, by way of which connection plates 18 one spraying nozzle 19 respectively is supplied which is provided with a bent connection pipe piece 20. In a manner not shown in detail here, one mixing chamber respectively is provided inside the connection plate 18, in which mixing chamber, the compressed air and the cooling liquid are mixed and are then guided by way of a connection piece 21 and the connection pipe piece 20 to the spraying nozzles 19. Also in this case, the spraying jets 14 are adapted to the shape of the billet S, which also applies to the bending angle of the connection pipe piece 20. This connection pipe piece 20 is connected in a torsion-proof manner with the connection piece 21 of the connection plate 18 and is secured by way of a union nut, so that the connection pipe piece 20 can be joined to the connection piece 21 only in a defined position. The spraying nozzle 19 can therefore be aligned only in the position indicated on top or in the position indicated below, the two positions occurring by a 180° rotation of the connection plates 18. In this embodiment, the connection plates 18 may also be provided with a regulating device 22 for controlling the compressed-air/cooling liquid ratio.

Also this embodiment permits an easy and precise mounting or demounting in that the stud 23, which in each case holds the connection plate 18 on the flange 4, is released and the corresponding spraying nozzle unit is removed, is serviced and is then attached again in a precise manner. The torsion-proof connection between the connection pipe piece 20 and the connection piece 21 and its securing by means of a union nut 24 is known per se and will therefore not be explained in detail.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A casting cooling arrangement for a stand of a continuous casting system for heavy supports with spraying nozzles which can be acted upon by a cooling liquid and by compressed air through supply pipes laid laterally in a longitudinal direction of the stand, wherein one cooling-liquid and compressed-air pipe respectively are assigned to stand side and are laid in parallel with respect to one another and are provided with connection points for joining of connection plates which are fixedly connected with the spraying nozzles:

wherein the connection points are constructed as connection flanges to which the connection plates can be joined; and wherein the connection flanges are arranged on one side on the supply pipes and connection links are situated at an opposite side by the supply pipes, and wherein studs for mounting the connection plates are guided through a gap between the supply pipes to the links.

2. Cooling arrangement according to claim 1, wherein the supply pipes are laid below one another or side-by-side at a narrow mutual distance.

3. A casting cooling arrangement for a stand of a continuous casting system for heavy supports with spraying nozzles which can be acted upon by a cooling liquid and by compressed air through supply pipes laid laterally in a longitudinal direction of the stand, wherein one cooling-liquid and compressed-air pipe respectively are assigned to each stand side and are laid in parallel with respect to one another and are provided with connection points for joining of connection plates which are fixedly connected with the spraying nozzles;

wherein the connection points are constructed as connection flanges to which the connection plates can be joined; and wherein the connection flanges are provided on both sides of the supply pipes and are each used for receiving at least one stud for flanging-on of the connection plates.

4. Cooling arrangement according to claim 1, wherein the connection plate is part of a spacer pipe unit which is connected with the supply pipes and ends in another flange which can be fixedly connected with a nozzle housing which is provided with two spraying nozzles situated at an angle ($\alpha$) with respect to one another and with respect to the axes of the spacer pipes.

5. Cooling arrangement according to claim 3, wherein one connection plate respectively is connected with each connection flange, which connection plate is provided with a mixing chamber in an interior connected by way of connection ducts with the supply pipes, and has an outlet connection piece which is connected with a connection pipe piece to a spraying nozzle.

6. Cooling arrangement according to claim 5, wherein the connection pipe piece is bent with respect to a laying plane of the supply pipes situated side-by-side.

7. Cooling arrangement according to claim 6, wherein the connection pipe piece is detachably joined to the connection piece of the connection plate.

8. Cooling arrangement according to claim 7, wherein the connection piece and the connection pipe piece are held on one another in a torsion-proof manner.

9. A casting cooling system for cooling cast parts longitudinally movable supported on a stand, comprising:

a cooling liquid nine extending in use longitudinally along a first side of the stand, a compressed gas supply pipe extending in use longitudinally along the first side of the stand, adjacent to the cooling liquid nine, connection parts on each of the nines including respective lateral openings, a connection plate detachably joined with the connection parts of both of the pipes, a mixing chamber for mixing the cooling liquid and compressed gas to form a cooling mixture from the pines, a spraying nozzle fixably supported at the connection plate and operable to spray the cooling mixture against a cast billet on the stand, and wherein said mixing chamber is disposed in a housing disposed downstream of and spaced from the connection plate.

10. A casting cooling system for cooling cast parts longitudinally movable supported on a stand, comprising:

a cooling liquid nine extending in use longitudinally along a first side of the stand, a compressed gas supply pipe extending in use longitudinally along the first side of the stand, adjacent to the cooling liquid pipe, connection parts on each of the nines including respective lateral openings, a connection plate detachably joined with the connection parts of both of the pines, a mixing chamber for mixing the cooling liquid and compressed gas to form a cooling mixture from the pipes, a spraying nozzle fixably supported at the connection plate and operable to spray the cooling mixture against a cast billet on the stand, and wherein said connection plate and spraying nozzle are part of an assembly which is detachable as a unit from the connection parts of the pipes, which assembly includes means for disposing the spraying nozzle at a predetermined position to thereby obviate any need for any other adjustment of the spraying nozzle position when the assembly is exchanged for maintenance or replacement.

11. A cooling system according to claim 10, wherein said mixing chamber is disposed in said connection plate.

12. A cooling system according to claim 10, wherein said mixing chamber is disposed in said connection plate.

13. A cooling system according to claim 10, wherein said mixing chamber is disposed in a housing disposed downstream of and spaced from the connection plate.

14. A cooling system according to claim 10, wherein a pair of said spraying nozzles are included in said assembly.

15. A cooling system according to claim 10, wherein only two pipes are provided at a first side of the stand, which two pipes supply a plurality of spray nozzles.

16. A casting cooling arrangement for a stand of a continuous casting system for heavy supports with spraying nozzles which can be acted upon by cooling liquid and by compressed air through supply pipes laid laterally in a longitudinal direction of the stand, wherein one cooling-liquid and compressed-air pipe respectively are assigned to each stand side and are laid in parallel with respect to one another and are provided with connection points for joining of connection plates which are fixedly connected with the spraying nozzles, wherein the connection points are constructed as connection flanges to which the connection plates can be joined, wherein one connection plate respectively is connected with each connection flange, which connection plate is provided with a mixing chamber in an interior connected by way of connection ducts with the supply pipes, and has an outlet connection piece which is connected with a connection pipe piece to a spraying nozzle, and wherein the connection pipe piece is bent with respect to a laying plane of the supply pipes situated side-by-side.

17. Cooling arrangement according to claim 16, wherein the connection pipe piece is detachably joined to the connection piece of the connection plate.

18. Cooling arrangement according to claim 17, wherein the connection piece and the connection pipe piece are held on one another in a torsion proof-manner.

19. Cooling arrangement according to claim 16, wherein the connection flanges are provided on both sides of the supply pipes and are each used for receiving at least one stud for flanging on the connection plates, wherein the connection plates are identical and can be fixed to opposite sides of the supply pipes by a 180° rotation of the connection plates.

* * * * *